US006227876B1

(12) United States Patent
Hanlon

(10) Patent No.: US 6,227,876 B1
(45) **Date of Patent: *May 8, 2001**

(54) ELECTRICAL CONTACT AND METHOD OF MAKING THE SAME

(75) Inventor: Terrance W. Hanlon, Blaine, MN (US)

(73) Assignee: RMS, Minneapolis, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,505

(22) Filed: Sep. 2, 1999

Related U.S. Application Data

(60) Provisional application No. 60/099,428, filed on Sep. 8, 1998.

(51) Int. Cl.[7] ..... H01R 9/09

(52) U.S. Cl. ..... 439/82

(58) Field of Search ..... 439/81, 82–84, 439/751, 733.1, 873, 825–827; 29/882, 874, 872, 876

(56) References Cited

U.S. PATENT DOCUMENTS

| | | | | |
|---|---|---|---|---|
| 4,486,068 | * | 12/1984 | Ghigliotti et al. | 339/252 |
| 4,596,437 | * | 6/1986 | Rush | 339/221 |
| 5,397,253 | * | 3/1995 | Fries | 439/825 |
| 5,695,357 | | 12/1997 | Wright . | |

* cited by examiner

*Primary Examiner*—Gary F. Paumen
*Assistant Examiner*—Phuongchi Nguyen
(74) *Attorney, Agent, or Firm*—Dorsey & Whitney LLP

(57) ABSTRACT

A compliant contact having two or more spaced compliant bridges for insertion into and removal from a conductive hole and a method of making such a contact.

18 Claims, 3 Drawing Sheets

19
27
18
16
11
30
20
12
22
8
24
21
25
31
33
28
14
32
15

19
27
18
16
11
22
12
26
20
24
30
29
1"d"
25
26
31
32
33
15

28
31
28
20
21
15
31

20
19
15
31
16
31
18
21

ELECTRICAL CONTACT AND METHOD OF MAKING THE SAME

This application claims the benefit of provisional application Ser. No. 60/099,428 filed Sep. 8, 1998.

BACKGROUND OF THE INVENTION

1. Field of the Invention

The present invention relates generally to an electrical contact and a method for making the same, and more particularly, to a compliant pin or compliant contact that press fits into a plated or conductive hole of a printed circuit. The method aspect of the present invention relates to a method of making the compliant contact and more specifically the compliant section of the contact.

2. Description of the Prior Art

Electrical contacts, commonly referred to as compliant contacts, are used in place of soldered pins to make connections to plated or conductive through holes in printed circuit boards or the like. Because a compliant contact is not soldered, it can be more readily removed and reinserted than a soldered pin, thereby facilitating maintenance. A primary problem with compliant contacts, however, is that repeated insertion and removal, particularly insertion and removal with a poorly fitting contact or a contact that does not have the right flex, can damage the plated hole. For example, a primary objective of a non-soldered compliant contact is for the contact to engage the plated hole with sufficient surface area and force so that a good electrical connection can be made, but not so great as to damage or scrape off or otherwise damage some of the electrically conductive plating layers on the inside of the contact hole. This is a problem compounded because of the variance in diameters and tolerances of the plated holes.

A variety of compliant contacts are known in the art. A common compliant contact known as a "fish eye" includes a centrally positioned portion having an elongated opening or "fish eye" extending through the center section to provide a pair of compliant blades. Such a compliant contact is illustrated in U.S. Pat. No. 5,575,666 issued to Dent. The center opening in many prior art compliant contacts is formed by stamping. Although such technique is satisfactory for various types of contacts, several limitations exist. First, the tooling for a stamping operation is quite expensive. Second, stamping operations become more difficult as the size of the contact and the material thickness increases. Thus, stamping processes become less desirable for larger compliant contacts. Thirdly, the impact of stamping can sometimes lead to work hardening and thus a change of the material properties.

Accordingly, there is a need in the art for an improved compliant contact and an improved method for making a compliant contact which overcomes the limitations in the prior art.

SUMMARY OF THE INVENTION

In contrast to the prior art, the present invention relates to an electrical contact, and specifically a compliant contact, which is particularly applicable to larger contacts and which overcomes the limitations of stamping processes commonly utilized in the prior art to form the compliant section. The compliant contact in accordance with the preferred embodiment of the present invention includes a first or forward shank/entry region which has an outer diametrical dimension less than the diametrical size of the conductive hole into which the compliant contact is intended to be inserted and includes a central contact hole extending through the shank/entry region along the longitudinal axis of the contact. Positioned rearwardly of the forward shank region is a second or compliant region which comprises a pair of compliant bridges extending rearwardly of the shank region and being spaced from one another. Positioned rearwardly of the complaint region is a relief region connected to the rearward ends of the compliant bridges and having an outer diametrical less than that of the conductive hole. The relief region is in turn connected to a mounting portion for mounting the contact to a connector in a manner known in the art.

In the preferred embodiment, the contact hole which extends through the forward shank region also preferably extends through at least a portion of the compliant region to define the spacing between the pair of compliant bridges and most preferably extends into a portion of the relief region as well. The compliant region preferably includes a first section with an outer surface which tapers outwardly and rearwardly, a second section which is positioned rearwardly of the first section and has an outer diametrical dimension greater than the dimension of the conductive hole and a third section with an outer surface which tapers rearwardly and inwardly.

The method aspect of the present invention includes forming a contact member having a longitudinal axis and forward and rearward sections with first and second diametrical dimensions. In the preferred embodiment, the contact member is formed by a turning, milling or other machining operations. Next, a contact hole is formed through the entire forward section of the contact member and through at least a portion of the rearward section along the longitudinal axis. Finally, a recess is formed in the outer wall of the rearward section. The recess extends inwardly from the outer wall of the rearward section toward the longitudinal axis for a sufficient distance to expose a portion of the contact hole. This recess, together with the central contact hole forms a pair of compliant bridges in the rearward section.

Accordingly, it is an object of the present invention is to provide an improved electrical contact, and more specifically, a compliant contact which overcomes the limitations in the prior art.

Another object of the present invention is to provide a compliant contact which has particular applicability to larger contacts intended to carry power.

Another object of the present invention is to provide an electrical connector having an improved compliant contact.

A further object of the present invention is to provide an improved method for making a compliant contact.

A still further object of the present invention is to provide an improved method of making the compliant portion of a compliant contact.

These and other objects of the present invention will become apparent with reference to the drawings, the description of the preferred embodiment and the appended claims.

DESCRIPTION OF THE PREFERRED EMBODIMENT

The preferred embodiment of the present invention relates to a compliant contact which is intended for insertion into, and removal from, a conductive or plated hole in a printed circuit board. In general, a compliant contact includes a forward lead in, entry or shank region with a dimension less than that of the conductive hole, a compliant region with a dimension slightly greater than that of the conductive hole and a rearward relief region with a dimension less than that of the conductive hole.

Figure 1:
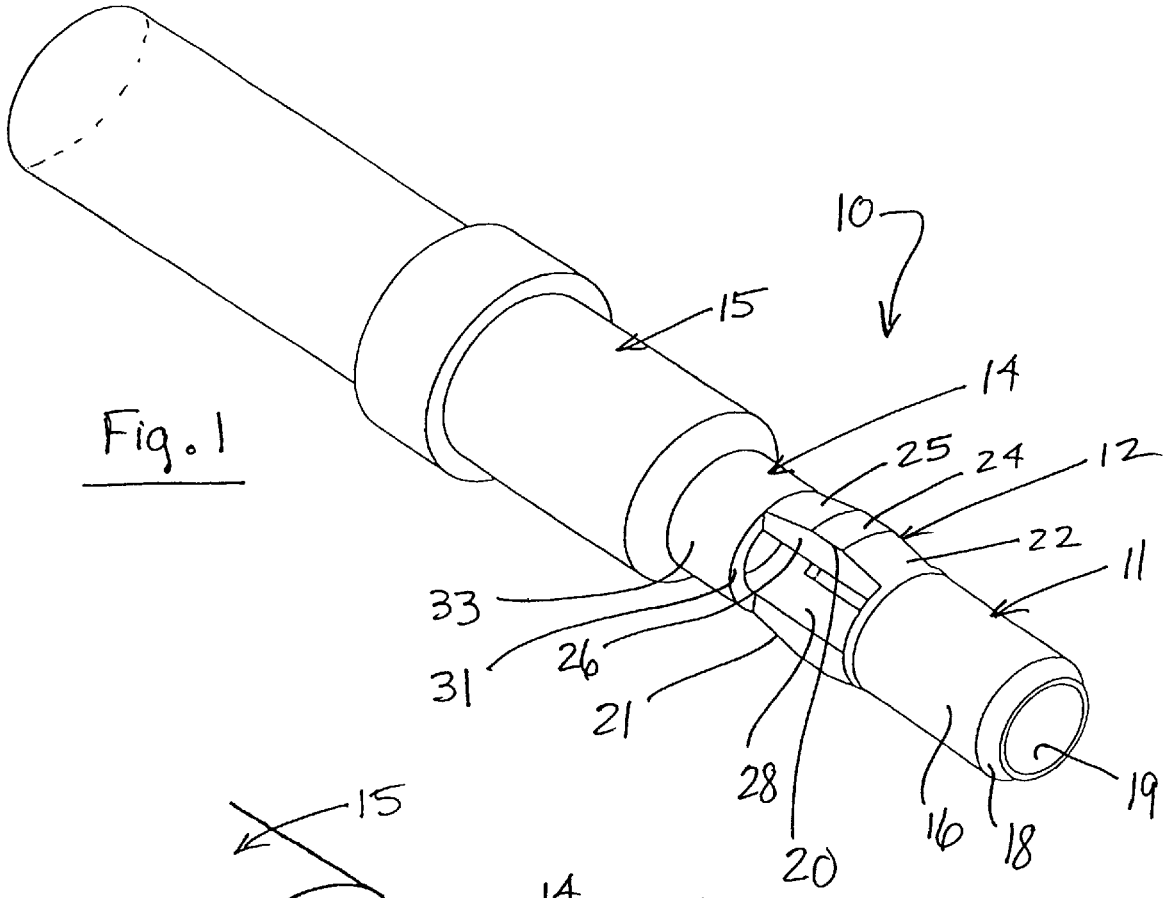
FIG. 1 is an isometric view of the compliant contact in accordance with the present invention.
Figure 2:
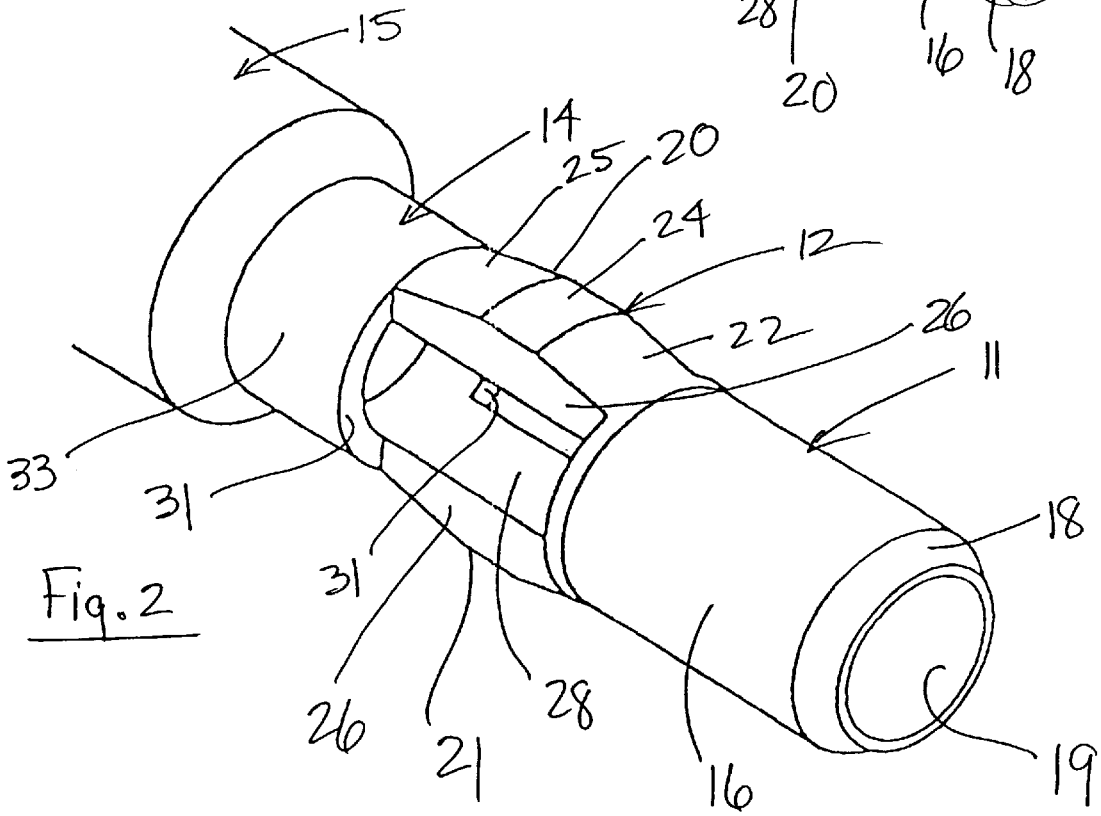
FIG. 2 is an enlarged isometric view of the forward end of the compliant contact of the present invention.
Figure 9:
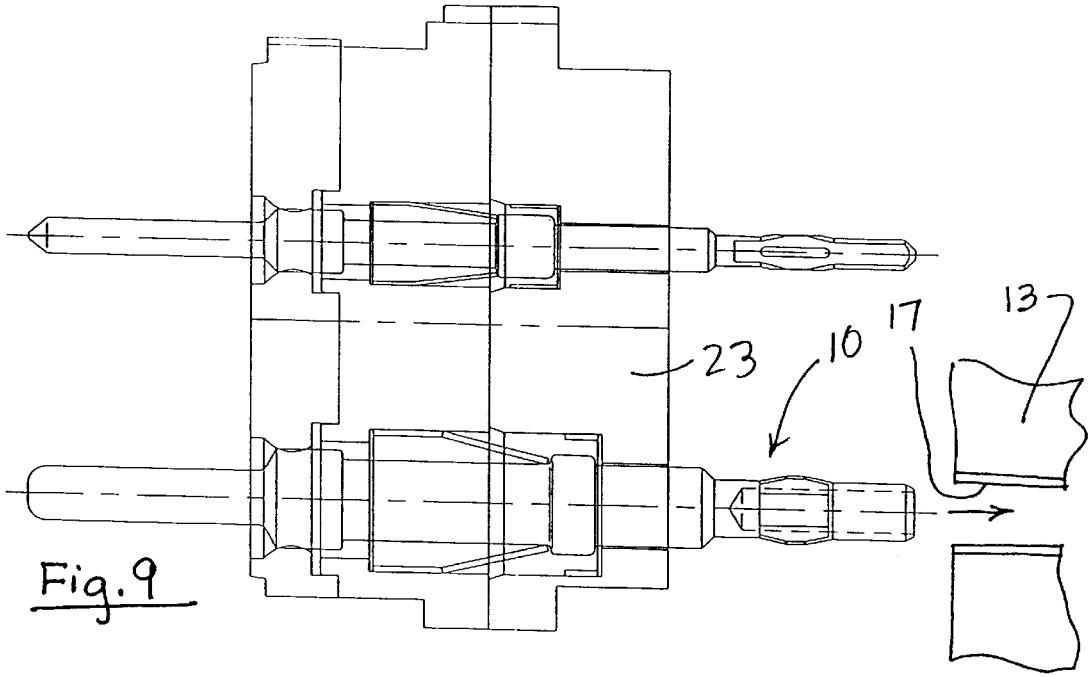
FIG. 9 is a connector showing the connection between the compliant contact of the present invention and a connector base.

The compliant contact 10 in accordance with the present invention is illustrated best in FIGS. 1, 2, 5, 6, 7 and 8 showing various views of the completed compliant contact in accordance with the present invention. In general, the compliant contact 10 is generally elongated and includes a longitudinal axis and first, second and third regions defined more specifically as a forwardly positioned shank or entry region 11, a centrally positioned compliant region 12 and a rearwardly positioned relief region 14. The rearward end of the relief region 14 is connected with the contact mounting portion 15. The mounting portion 15 is in turn mounted to a connector member 23 (FIG. 9) in a manner known in the art. As shown in FIG. 9, the compliant contact 10 of the connector 23 is intended for insertion into and removal from a plated or conductive hole 17 of a printed circuit board or other substrate 13.

With reference to FIGS. 1, 2, 5, 6 and 7, the entry or shank region 11 includes an outer surface 16, a forward chamfered end 18 and an internal contact hole or bore 19. In the preferred embodiment, the outer surface 16 is a cylindrical surface formed by a turning, milling or other machining process. The contact hole 19 of the preferred embodiment is also generally cylindrical and is concentric with the outer cylindrical surface 16 and the longitudinal axis of the contact 10. The surface 16 and thus the entry region 18 has a width or outer diametrical dimension which is less than the conductive hole 17 into which the compliant contact is intended for insertion.

Figures 5, 6, 7, 8:
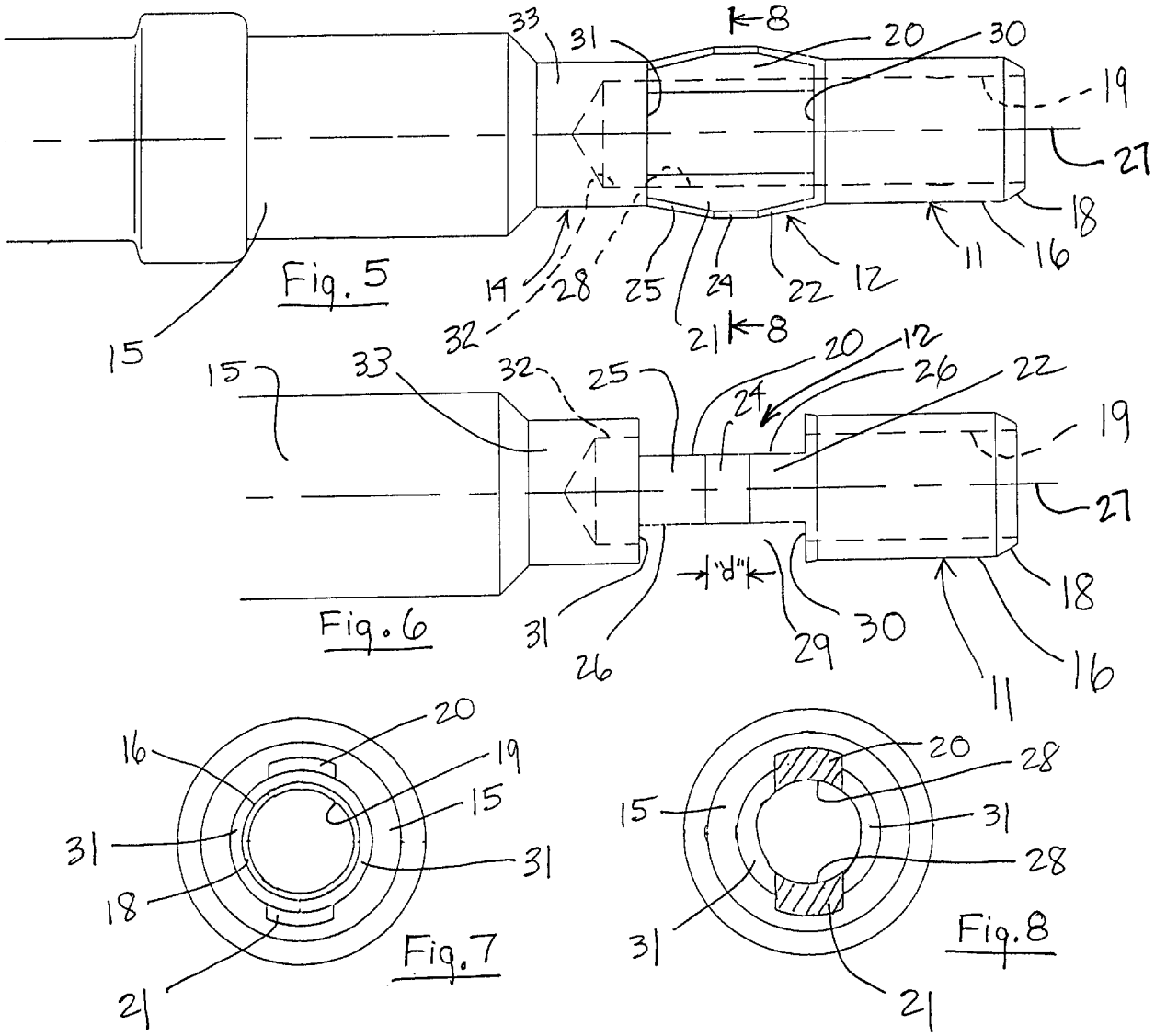
FIG. 5 is a side elevational view of a completed compliant contact in accordance with the present invention.
FIG. 6 is a top elevational view of a completed compliant contact in accordance with the present invention.
FIG. 7 is an end elevational view of the compliant contact in accordance with the present invention as viewed from the forward end of the contact.
FIG. 8 is a view, partially in section, as viewed along the section line 8—8 of FIG. 5.

The compliant section 12 is comprised of a pair of compliant conductive bridges or bridge sections 20 and 21. The bridges 20 and 21 extend rearwardly from the rearward end of the entry region 11 and are radially spaced from one another relative to the longitudinal axis 27 (FIGS. 5 and 6). Each of the bridges 20 and 21 includes a first of forward section 22, a second or central section 24 and a third or rearward section 25. As shown, the forward section 22 is adjacent to the rearward end of the entry region 11 and includes an outer, partially conically shaped exterior surface which tapers outwardly and rearwardly relative to the longitudinal axis 27 of the contact. Although the preferred embodiment illustrates the surface of the section 22 as being conical in that it extends outwardly and rearwardly in a generally straight line, it could, if desired, be provided with a radius or other configuration as well. Preferably, the forward end of the section 22 has an outer diametrical dimension less than that of the conductive hole 17 into which the contact is intended to be inserted. The rearward end of the section 22 joins with the forward end of the central section 24 and preferably has an outer diametrical dimension greater than that of the conductive hole 17.

The central section 24 is positioned immediately rearwardly of the section 22 and preferably is provided with an outer surface portion which is generally cylindrical. In the preferred embodiment, this surface is cylindrical so as to improve electrical contact with the internal cylindrical surface of the conductive hole 17 into which the contact is to be inserted. If desired, however, the outer surface 24 can be provided with a radius in the direction of the longitudinal axis of the contact. Preferably the entire central section 24 has an outer diametrical dimension which is slightly greater than the conductive hole into which the contact is intended for insertion.

The third or rearward section 25 is provided with an exterior surface which is partially conically shaped and which tapers inwardly and rearwardly relative to the longitudinal axis 27 of the contact. The section 25 is positioned adjacent to the rearward end of the central section 24 and thus extends rearwardly from the section 24 to the relief region 14. The forward end of the section 25 has an outer diametrical dimension which is preferably greater than that of the conductive hole 17, while the rearward end of the section 25 has an outer diametrical dimension which is preferably less than that of the conductive hole. Similar to the section 22, the section 25 can be provided with a curvature or radius in the direction of the longitudinal axis; however preferably the outer surface of the section 25 is a partial conical surface.

Each of the bridges 20 and 21 is further defined by a pair of side surfaces 26 extending generally parallel to each other and parallel to the longitudinal axis 27 of the contact. The distance between the surfaces 26 of each bridge 20 and 21 defines a lateral dimension of the bridge. As shown best in FIGS. 1, 2 and 8, the inner surface of each of the bridges 20 and 21 is a concave, inner cylindrical surface 28 having a diameter or radius of curvature similar to the contact hole 19 extending through the entry region 11. The distance between the surfaces 28 of each bridge 20 and 21 and the outer surfaces of the first, second and third sections 22, 24 and 25 defines the radial or thickness dimensions of the bridge. As will be described in greater detail below, the inner surfaces 28 of the bridges 20 and 21 are preferably formed by drilling the hole 19 through the entry region 11 and at least partially through the compliant region 12. Accordingly, the bridges 20 and 21 are spaced from one another and each have an inner surface and an outer surface spaced radially outwardly from the inner surface to define a radial thickness dimension of the bridge which varies over the length of the bridge.

The compliant region 12, and particularly the bridges 20 and 21, are defined in part by a pair of recesses 29 (FIG. 6) formed in diametrically opposite outer side walls of the compliant region 12. The recesses 29 are defined at their ends by the end walls 30 and 31 and defined inwardly by the side walls 26 of the bridges and 20 and 21. As shown, the recesses 29 extend inwardly toward the longitudinal axis 27 a sufficient distance so that it intersects with the contact hole 19. This intersection forms the opening or spacing between the bridges 20 and 21 and thus defines the compliant bridges.

The relief region 14 is positioned immediately rearwardly of the compliant region 12 with the forward end of the relief region 14 extending rearwardly of the rearward end of the section 24. The relief region 14 includes an outer, generally cylindrical surface 33 having an outer diametrical dimension less than that of the contact hole 17 into which the compliant contact is intended for insertion. The rearwardly end of the relief region 14 is integrally joined or formed with a connector mounting portion 15 for connection to a connector member 23 (FIG. 9) in a manner known in the art. As illustrated best in FIGS. 4, 5 and 6, a portion of the relief region 14 is provided with an internal hole or bore 32 which has dimensions similar to that of the contact hole 19 and which is preferably a continuation of the contact hole 19. In the preferred embodiment, the hole 32 extends partially through the relief region 14 as shown.

With reference to FIG. 6, the compliant region 12 is defined by the length of the recesses 29 between the end surfaces 30 and 31. Preferably the length "d" of the central section 24 in the direction of the longitudinal axis 27 is about 10% to 50% of the length of the recesses 29 and most preferably about 15% to 40% of such length.

When is use, the compliant contact in accordance with the present invention is designed for insertion into, and removal from a plated or conductive hole 17 in a printed circuit board 13. In order for sufficient electrical contact to be made, the compliant region or portion 12 of the compliant contact must have a portion with a diametrical dimension greater than that of the conductive hole 17. Also, the compliant region 12, and specifically the bridges 20 and 21, should preferably flex so that when inserted into the conductive hole 17, they flex inwardly to enable full insertion of the contact. The ability of the compliant contact to flex is a feature which affects the acceptability of the compliant contact. This flex can be adjusted and thus varied with several design factors. One factor is the size of the contact hole extending through the contact. This hole is defined by the hole 19 in the entry region 11, by the surfaces 28 in the compliant region 12 and by the hole 32 in the relief region 14. The size of this hole, particularly in the compliant region 12 defines the radial thickness of the bridges 20 and 21 and thereby impacts the flexibility of the bridges. Thus, the flexibility of the bridges is directly related to the size of the contact hole, namely, the bigger the contact hole, the greater the flexibility and the smaller the hole, the less the flexibility. Secondly, the flex of the bridges 20 and 21 can be adjusted by varying the lateral dimension of the bridges 20 and 21, and thus the depth of the recesses 29. Specifically, an increase in the depth of the recesses 29 will decrease the lateral dimension of the bridges 20 and 21 between the side surfaces 26, and thus increase the flexibility of the bridges, while a decrease in the depth of the recesses 29 will decrease the flexibility of the bridges. Thirdly, the flex of the bridges 20 and 21 can be adjusted by varying the longitudinal dimension of the recesses 29 between the ends 30 and 31 in a direction of the longitudinal axis of the contact. Specifically, a decrease in this dimension results in a corresponding decrease in the length of the compliant region 12 and thus a decrease in the flexibility of the bridges. On the other hand, an increase in the longitudinal dimension of the recesses 29 results in a corresponding increase in the length of the bridges 20 and 21 and thus an increase in their flex.

Figure 3:
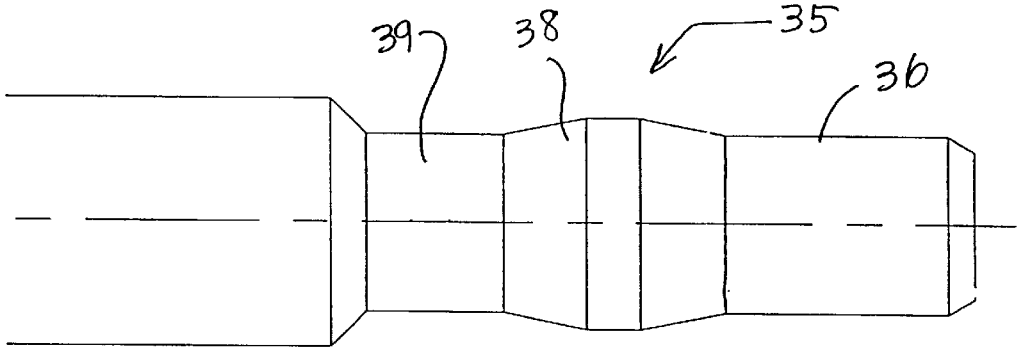
FIG. 3 is a side elevational view of the contact member following the contact member forming step in accordance with the method of the present invention.

Having described the structure of the compliant contact in accordance with the present invention, the method of making the compliant contact can be understood best as follows. The first step in making the compliant contact in accordance with present invention is to form a contact member 35 such as that illustrated in FIG. 3. Such contact member 35 has a longitudinal axis, a first or forward region 36 with a first diametrical dimension, a second or rearward region 38 with a second diametrical dimension, and a third or more rearward region 39 with a third diametrical dimension. Preferably the second diametrical dimension is greater than the first and third diametrical dimensions. The first and third diametrical dimensions are less than that of the conductive hole 17 and the second diametrical dimension is greater than that of the conductive hole. Although a variety of forming means may be utilized in this first forming step, the preferred embodiment contemplates that the contact member would be formed by turning, milling or some other machining process. Preferably the contact member is provided exclusively with cylindrical or conical surfaces, or surfaces having a curvature along the longitudinal axis of the member 35. Preferably the contact member and thus the entire compliant contact is made from beryllium copper, although other materials can also be used. In the final contact, the regions 36, 38 and 39 become the regions 11, 12 and 14, respectively.

Figure 4:
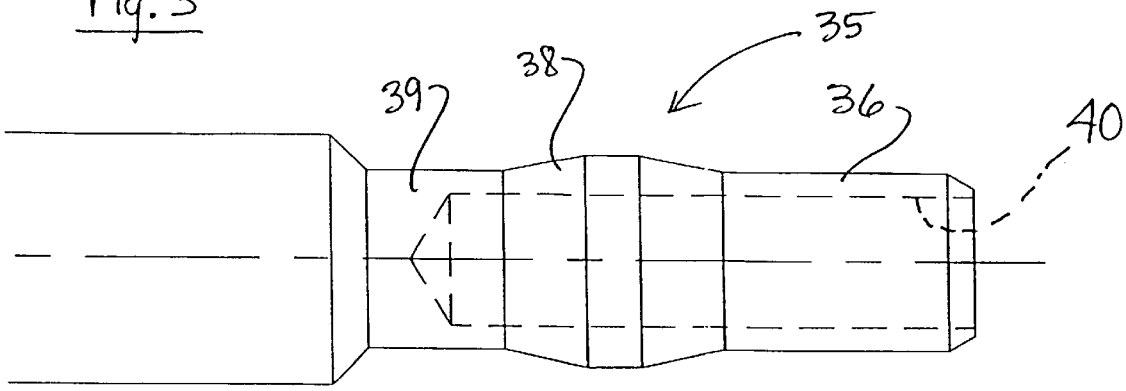
FIG. 4 is a side elevational view of the contact member following the contact hole forming step in accordance with the method of the present invention.

The second step in the process of making the compliant contact is to form a contact hole 40 through the forward section 36 of the contact member 35 and through at least a portion of the rearward section 38 and along the longitudinal axis as shown in FIG. 4. Most preferably, this contact hole extends entirely through the forward section 36, entirely through the rearward section 38 and partially through the more rearward section 39. The diameter of the hole 40 is preferably less than the smallest outer diameter of the contact member 35 and is preferably formed by drilling or some other boring process. In the final contact, the hole 40 forms the contact hole portion 19, the inner surfaces 28 and the contact hole portion 32.

The third step in the process of making the compliant contact in accordance with the present invention is to form the recesses 29 (FIG. 6) in that portion of the contact member which defines the compliant section 12. Specifically, in the preferred embodiment, the recesses 29 are formed in diametrically opposite sides of the outer wall. The recesses 29 extend inwardly from the outer wall toward the longitudinal axis a sufficient distance to expose a portion of the contact hole. Thus, the combination and intersection of the contact hole and the recesses form and define the inner surfaces 28 and side surfaces 26 of the bridges 20 and 21. Preferably the step of forming the recesses includes a milling or other machining step.

Although the preferred structure shows a pair of bridges 20 and 21, it is contemplated that the structure could also embody three or four or more bridges and still exhibit the benefits of the present invention. The specific structure will depend primarily upon the requirements of contact size and the like.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

What is claimed is:

1. A compliant contact for insertion into a conductive hole comprising:

a forward shank region having a width less than the conductive hole;

a compliant region with a portion having a diameter greater than the conductive hole comprising two or more conductive bridges extending rearwardly of said entry region, said bridges being spaced from one another and having an inner surface and an outer surface spaced radially outwardly from said inner surface to define a radial thickness dimension, wherein said radial thickness dimension varies over the length of said bridge; and a contact hole having a first portion extending through said shank region and a second portion extending through at least a portion of said compliant region, wherein said second portion of said contact hole is of substantially constant diameter throughout and defines said inner surface of said bridges.

2. The compliant contact of claim 1 wherein said compliant contact has a longitudinal axis and wherein each of said bridges includes a contact surface comprising a partial cylindrical surface being generally parallel to said longitudinal axis and having its center of curvature concentric with said longitudinal axis.

3. The compliant contact of claim 1 wherein each of said bridges includes a forward section, a central section and a rearward section, wherein said forward section includes an outer surface tapering outwardly and rearwardly from said shank region toward said central section, said rearward section includes an outer surface tapering inwardly and rearwardly from said central section and said central section includes an outer surface with a diametrical dimension greater than the conductive hole.

4. The compliant contact of claim 1 wherein said first and second portions of said contact hole are of substantially constant diameter throughout.

5. The complaint of claim 1 wherein said inner surface of said bridges is a generally cylindrical surface.

6. An electrical connector comprising:

a connector member and at least one of the compliant contacts of claim 1 connected with said connector member and extending outwardly therefrom.

7. The electrical connector of claim 6 including a plurality of said compliant contacts connected with said connector member and extending outwardly therefrom.

8. The compliant contact of claim 1 wherein each of said two or more bridges include a pair of side walls and the compliant contact further includes a recess circumferentially positioned between adjacent bridges, said recess comprising a pair of sides defined by the side walls of said adjacent bridges and first and second end walls and intersecting with said second portion of said contact hole.

9. The compliant contact of claim 8 wherein said pair of side walls of each bridge are generally parallel to one another.

10. The compliant contact of claim 1 including a relief region connected with and extending rearwardly of said two or more bridges, said relief region having a width less than said conductive hole.

11. The complaint contact of claim 10 including a connector region extending rearwardly of said relief region.

12. The compliant contact of claim 10 wherein said contact hole extends through the entirety of said compliant region and through at least a portion of said relief region.

13. An electrical contact comprising:

a first region having a forward end and a rearward end and a first outer diametrical dimension;

a second conductive region having an outer wall and positioned rearwardly of said first region, said second region including a first section positioned rearwardly of said first region and a second section positioned rearwardly of said first section with a second outer diametrical dimension, said second diametrical dimension being greater than said first diametrical dimension, said second region further including an inner surface and an outer surface spaced radially outwardly from said inner surface to define a radial thickness dimension, wherein said radial thickness dimension varies over the length of said second region;

a contact hole having a first portion extending through said first region from said forward end to said rearward end and a second portion extending through at least a portion of said second region, wherein said second portion of said contact hole is of substantially constant diameter throughout; and at least one recess in said second region outer wall, said recess extending inwardly from said outer wall at least to said second portion of said contact hole.

14. The electrical contact of claim 13 including a pair of said recesses on diametrically opposite sides of said second region.

15. The electrical contact of claim 13 wherein said first and second portions of said contact hole are of substantially constant diameter throughout.

16. The electrical contact of claim 13 wherein said contact includes a longitudinal axis and wherein said recess comprises a pair of sides circumferentially spaced from one another relative to said longitudinal axis and first and second end walls.

17. The electrical contact of claim 13 wherein said second region includes a third section positioned rearwardly of said second section wherein at least a portion of said third section and a portion of said first section have diametrical dimensions less than the diametrical dimension of said second region and greater than the diametrical dimension of said first region.

18. The electrical contact of claim 17 wherein said second portion outer wall includes first, second and third outer wall sections corresponding respectively to said first, second and third sections and wherein said recess extends inwardly from said second outer wall section and at least a portion of each of said first and third outer wall sections.

* * * * *